US006260586B1

(12) United States Patent
Fratus

(10) Patent No.: US 6,260,586 B1
(45) Date of Patent: Jul. 17, 2001

(54) RAIL MOUNTED WEFT CUTTING DEVICE WITH BLADE CARRYING ARMS

(75) Inventor: Gianmario Fratus, Lovere (IT)

(73) Assignee: Somet Societa' Meccanica Tessile, S.p.A., Bergamo (IT)

( * ) Notice: Subject to any disclaimer, the term of this patent is extended or adjusted under 35 U.S.C. 154(b) by 0 days.

(21) Appl. No.: 09/529,002

(22) PCT Filed: Sep. 15, 1998

(86) PCT No.: PCT/EP98/05872

§ 371 Date: Apr. 6, 2000

§ 102(e) Date: Apr. 6, 2000

(87) PCT Pub. No.: WO99/18275

PCT Pub. Date: Apr. 15, 1999

(30) Foreign Application Priority Data

Oct. 6, 1997 (IT) ..... MI97A02265

(51) Int. Cl.[7] ..... D03D 49/70
(52) U.S. Cl. ..... 139/291 C; 139/266; 139/302
(58) Field of Search ..... 139/266, 291 C, 139/302

(56) References Cited

U.S. PATENT DOCUMENTS

| | | | | |
|---|---|---|---|---|
| 2,633,157 | * | 3/1953 | Zabriskie et al. | 139/266 |
| 3,779,289 | * | 12/1973 | Bulcock et al. | 139/266 |
| 5,076,331 | * | 12/1991 | Debaes | 139/291 C |
| 5,649,570 | * | 7/1997 | Wahhoud et al. | 139/291 C |

FOREIGN PATENT DOCUMENTS

| | | |
|---|---|---|
| 1 218 502 | 5/1960 | (FR) . |
| 2 634 230 | 1/1990 | (FR) . |

* cited by examiner

*Primary Examiner*—Andy Falik
(74) *Attorney, Agent, or Firm*—Young & Thompson

(57) ABSTRACT

A device for cutting the weft yarn in weaving looms includes a fixed-blade and movable-blade cutting group which has associated motor for the cutting movement of the movable blade in order to perform cutting of the weft yarn. The fixed and movable blades are each mounted on the end of respective elongated blade-carrying arms which extend respectively above and below the fabric holder of the loom, as far as a cutting zone located beyond the leading edge of the fabric holder itself in the direction of the reed, a zone in which said blades overlap so as to perform cutting of the weft.

12 Claims, 3 Drawing Sheets

RAIL MOUNTED WEFT CUTTING DEVICE WITH BLADE CARRYING ARMS

BACKGROUND OF THE INVENTION

The present invention relates to a device for cutting the weft yarn in a weaving loom, and in particular in an air weaving loom, of the type suitable for forming weft ends of identical height and hence a fringe on the fabric which is perfectly uniform and aesthetically acceptable, without using a split selvedge.

DESCRIPTION OF THE RELATED ART

It is known that in air looms, both on the side for insertion and on the side for receiving the weft, cutting devices are mounted for performing cutting of the weft yarn, after the weft itself has been inserted into the shed and beaten-up against the fabric being formed. In order to obtain cutting of the various weft yarns inserted in succession into the shed, which is as uniform and homogeneous as possible, and hence obtain a fringe of weft ends of uniform and constant height, it is essential that cutting should be performed with the weft yarn perfectly tensioned.

In order to achieve this condition it is conventionally known in the art to insert an additional group of warp yarns at a certain distance from the last warp yarn of the fabric, thus obtaining the formation of a split selvedge. Special tensioning devices are able to act on the latter and keep the weft ends tensioned up to a zone which is sufficiently distant from the weaving zone and where the conventional cutting devices may be accommodated so as to separate the split selvedge by cutting the weft yarns arranged between the latter and the fabric to the desired uniform length. This weaving technique is able to achieve, as has been seen, a perfectly uniform fringe of weft ends, but it has the drawback that it uses a not insignificant additional amount of yarn for formation of the split selvedge.

More recently, therefore, in the sector of air looms, a technique for the formation of the weft end fringe, which no longer requires the formation of a split selvedge, has been introduced; cutting of the ends is in fact performed on each individual weft after the latter has been beaten-up. Cutting, however, must be preferably performed along the weft insertion line, i.e. along the launching channel formed in the reed of the loom; devices for pneumatically tensioning the weft yarn are, in fact, present along this line, both on the side for insertion and on the side for receiving the weft, said devices being able to keep the weft yarn perfectly stretched during the operation of cutting thereof, so as to ensure that cutting is performed reliably and that the height of the residual weft end is perfectly constant.

The need for the cutting members to be arranged in the immediate vicinity of the weft insertion line involves the consequent need for both the reed and the fabric holder on which the fabric being formed rests to have a longitudinal extension equal to the height of the fabric being processed. In the opposite case, in fact, i.e. when fabrics with a height less than the maximum effective weaving height of the loom are processed on the loom, the cutting devices could not be moved by the desired amount towards the edge of the fabric because they would interfere in fact with the reed and with the fabric holder.

As regards the reed, the problem is solved in a fairly simple manner by replacing on each occasion the reed with one which is of a size suitable for the fabric being processed. Since it is a compact component arranged "outside" the body of the loom, the reed may in fact be replaced rapidly and the only drawback is that associated with the need to stock different types of reeds in the different heights required in the case of the fabric holder, on the other hand, it is not possible to contemplate rapid replacement thereof with another one of suitable dimensions; the fabric holder, is in fact, a component situated inside the loom and in a zone thereof, moreover, where a series of closely arranged additional devices for controlling and regulating weaving is located, and it is therefore inconceivable to envisage replacement thereof in acceptably short time periods, considering also that, during assembly, said fabric holder must be carefully set in position, using spacers for the supports, in order to ensure that it is perfectly leveled.

In the known art it is therefore not possible to perform, hitherto, cutting of the weft yarn along the line for insertion thereof—both on the side for insertion and on the side for receiving the weft—when weaving is performed with a fabric width less than the maximum weaving width of the loom, unless special fabric holders of the telescopic type are used. These consist, as can be easily understood from the term used, of fabric holders formed as several parts—which can slide on one another and can be fixed together—so as to allow adjustment of the overall length of the fabric holder by the desired amount. This type of telescopic fabric holder, in addition to having a higher cost than conventional fabric holders, is also not without drawbacks. In fact, the variation in thickness—albeit small—which necessarily exists between the various fabric holder sections in the zones for mounting on top of one another and joining together two sections of the fabric holder, results in not perfectly uniform weaving. This type of fabric holder can therefore be used only for the production of inferior quality fabrics or for processing with large-size yarns, since in other cases the fabric would not be perfectly uniform, i.e. it would almost always show a weaving mark in the zone joining together two sections of the fabric holder.

SUMMARY OF THE INVENTION

The object of the present invention is therefore that of providing a device for cutting the weft yarn, which allows cutting of the weft yarn to be performed along the line of insertion of the weft, both on the insertion side and on the side-for receiving thereof, irrespective of the length of the fabric holder and the width of the fabric being processed, thus making it possible to dispense entirely with the need for a fabric holder of the telescopic type.

This object is achieved, according to the present invention, by means of a device for cutting the weft yarn in a weaving loom provided with a fabric holder, said cutting device comprising fixed-blade and movable-blade cutting means and motor means for the cutting movement of the movable blade in order to perform cutting of the weft yarn and also at least one guide rail which is transverse with respect to the loom and joined thereto and on which said cutting means are slidable and can be fixed, characterised in that said cutting means comprise a fixed blade group and a movable blade group provided with respective elongated blade-carrying arms on the ends of which said fixed blade and movable blade are mounted, said arms extending respectively above and below said fabric holder of the loom, as far as a cutting zone located beyond the leading edge of the fabric holder itself in the direction of the reed, a zone in which said blades overlap so as to perform cutting of the weft.

BRIEF DESCRIPTION OF THE DRAWINGS

The invention, however, will now be described more fully in detail, with reference to a preferred embodiment thereof, provided solely by way of example and illustrated in the accompanying drawings, in which.

DESCRIPTION OF THE PREFERRED EMBODIMENTS

Figure 1:
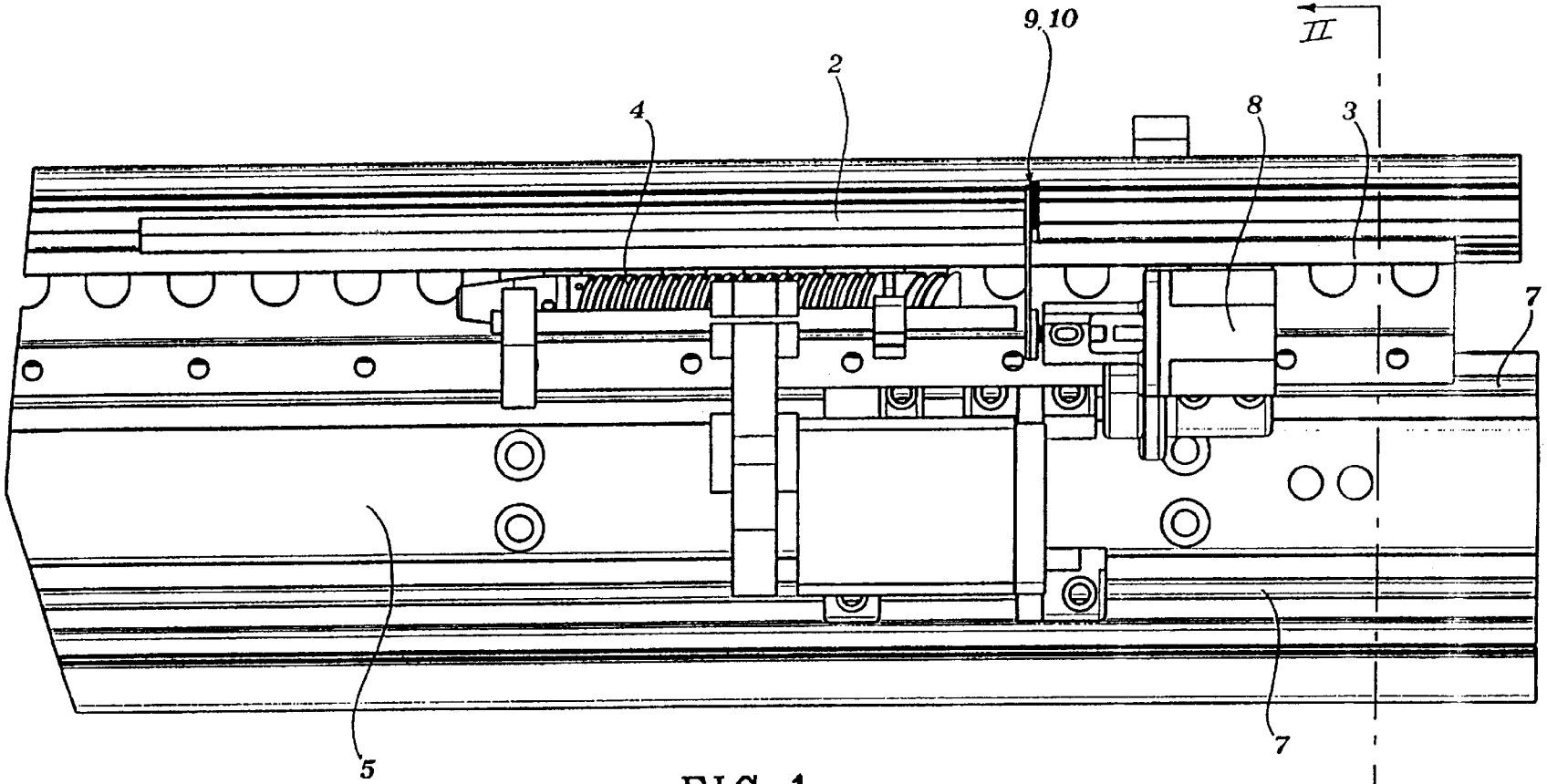
FIG. 1 is a schematic plan view of a side end portion of a weaving loom incorporating the cutting device according to the present invention.
Figure 3:
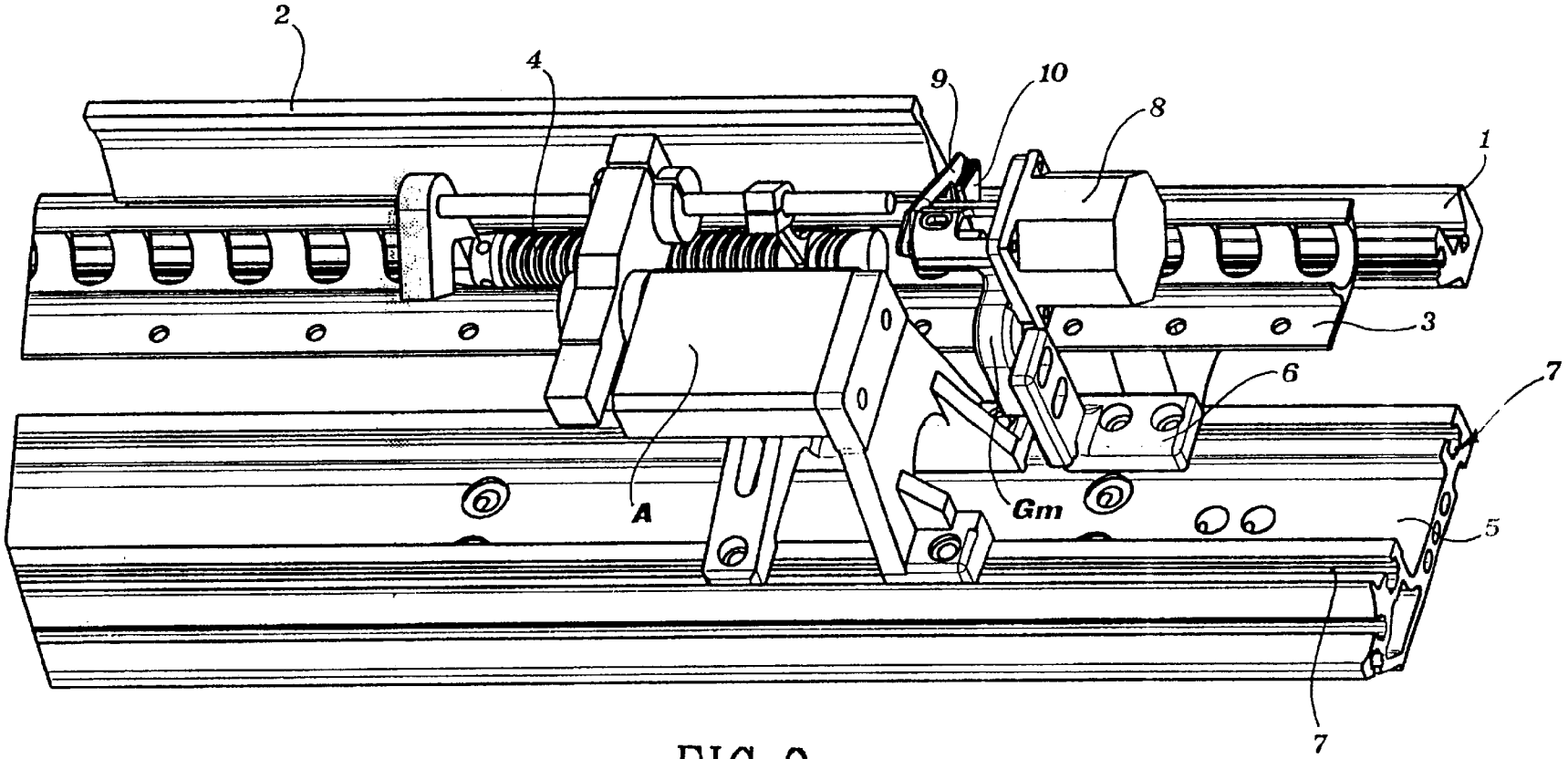
FIG. 3 is an axonometric schematic rear-side view of the same loom portion illustrated in FIG. 1.

The figures clearly show some of the parts which form the weaving zone of an air loom and, in particular, from right (rear side of loom) to left (front side of loom), the sley 1, the reed 2 (not illustrated for the sake of greater clarity in FIGS. 1 and 3), the fabric holder 3, the temple 4 and the base 5 of the loom on which the cutting device according to the present invention is mounted.

In the embodiment illustrated, the cutting device according to the present invention comprises a support 6 sliding on a rail 7 formed in the base 5. The support 6 is rapidly fixed to the rail 7 in any desired portion using screw-type fixing means or fast-action fixing means, all of which are widely known per se.

Figure 2:
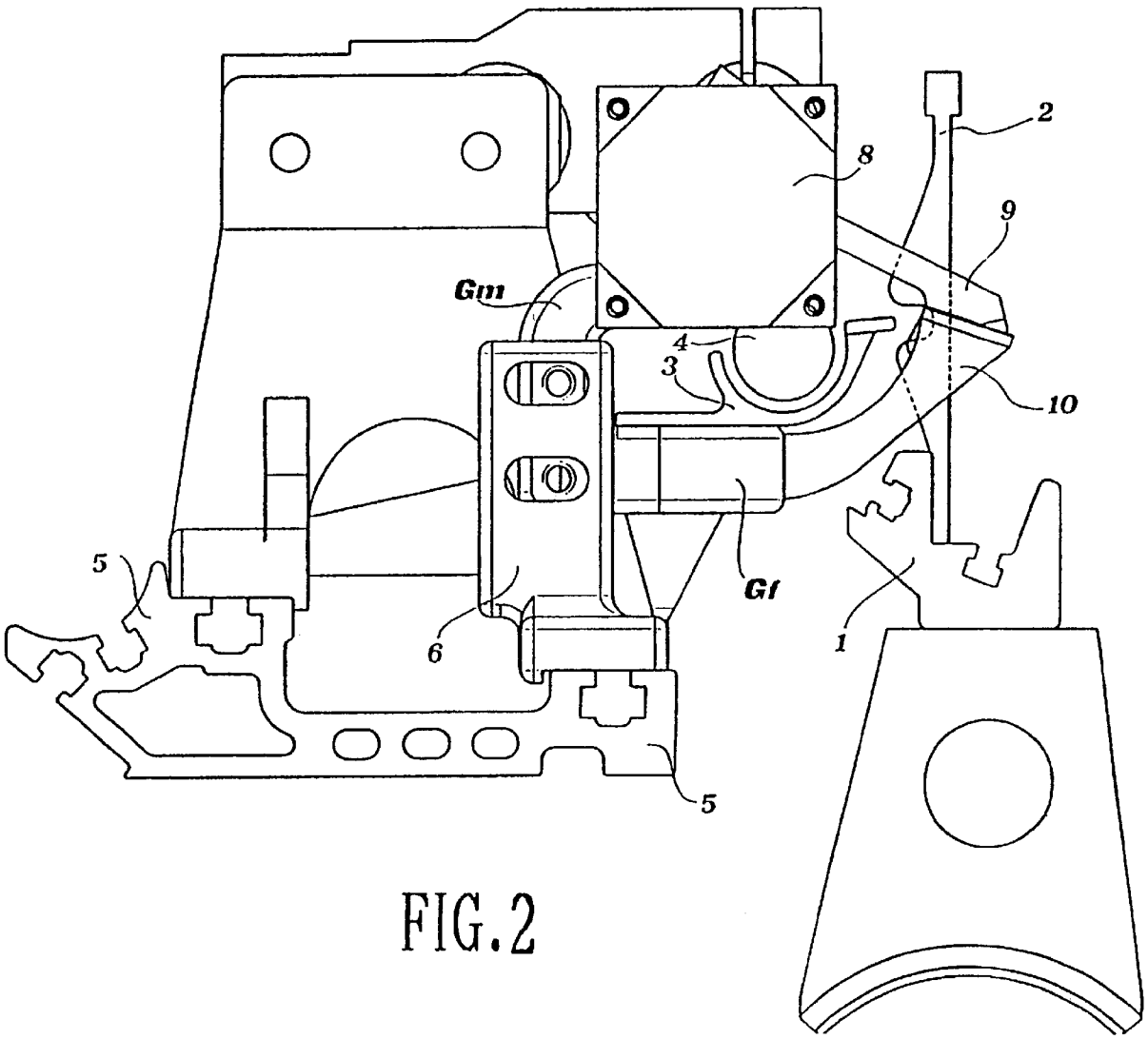
FIG. 2 is a schematic cross-sectional view along the line II—II of FIG. 1.

The movable-blade and fixed-blade cutting groups of the cutting device according to the present invention are fixed to the support 6. The movable-blade group Gm (FIGS. 2 and 3) comprises motor means 8 which consists, for example, of a pneumatic rotating actuator or an electric stepper motor and which has, fixed onto its drive shaft, one end of a movable blade-carrying arm 9 which extends above the fabric holder, while the fixed-blade group Gf comprises solely a fixed blade-carrying arm 10 which extends below the fabric holder. The two movable and fixed cutting groups Gm and Gf may be formed as a single body or as two separate bodies, but in either case they are both rigidly fixed to the support 6, so as to define a predetermined mutual position which, if necessary, may be adjusted; in this way, when the support 6 is displaced on the rail 7, the mutual position of the two cutting groups and therefore the setting for the cutting action of the blades thereof is not varied. According to the main characteristic feature of the invention, the two blade-carrying arms 9 and 10 have a considerable longitudinal extension and are formed so that their ends which carry the cutting blades intersect beyond the leading edge of the fabric holder 3, in the direction of the reed 2, i.e. precisely in the zone where the weft yarn is inserted, such that the cutting action performed by them fully achieves the desirable conditions described in the introduction.

From the above description it is obvious how the cutting device according to the present invention may be made to slide freely across the width of the loom and fixed in the most suitable position depending on the width of the fabric being processed, without it ever interfering with the fabric holder 3, which is in fact "enclosed" between the blade-carrying arms 9 and 10 and which may therefore be constructed as one piece with a longitudinal dimension equivalent to the maximum weaving width of the loom, thus ensuring the best weaving conditions and fully achieving the object of the invention.

In the embodiment illustrated, the cutting device comprises a support 6 independent of the support A of the temple 4 sliding on the rails 7. It is obvious, however, that said support 6 could advantageously be joined to the same support A of the temple 4 and movable along the rails 7. In this case the support 6 will be fixed at a predetermined optimum distance from the temple, whereas there will be preferably provided the possibility of micro-adjustment of the position of said support 6, so as to allow the possibility of variation in the length of the weft end from one processing operation to another.

The cutting device according to the present invention has been described with reference to a particular, currently preferred, embodiment thereof, but it must be clear that the scope of protection of the invention itself is not limited to this embodiment and comprises all the variants thereof within the grasp of a person skilled in the art, which fall within the general definition of the invention provided in the accompanying claims.

What is claimed is:

1. A weaving loom comprising:

a fabric holder;

a reed;

at least one guide rail running in a transverse direction of the loom;

a cutting device for cutting weft yarn, the cutting device having a cutting means mounted on the at least one guide rail and made up of a fixed blade mounted on an end of an elongated fixed-blade carrying arm, a movable blade mounted on an end of an elongated movable-blade carrying arm, and a motor operatively connected to the movable blade and arranged to provide a cutting movement of the movable blade in order to perform cutting of the weft yarn, the fixed-blade carrying arm and the movable-blade carrying arm extending respectively above and below the fabric holder in a direction of the reed so that a zone is formed in which the fixed blade and the movable blade overlap to enable cutting of the weft yarn.

2. The loom of claim 1, wherein the cutting means is slidably mounted on the at least one guide rail.

3. The loom of claim 1, wherein the cutting means is fixedly mounted on the at least one guide rail.

4. The loom of claim 3, wherein said loom further comprises a temple with a temple support and the single support is fixed to the temple support.

5. The loom of claim 4, wherein the single support is fixed to the temple support by a adjustable connection so that a position of the single support with respect to the temple support is adjustable.

6. The loom of claim 1, wherein the elongated fixed-blade carrying arm and the elongated movable-blade carrying arm are fixed to a single support in turn mounted on the guide rail.

7. The loom of claim 1, wherein the motor is directly joined to the movable-blade carrying arm.

8. A weaving loom cutting device adapted to be mounted on the at least one guide rail of a weaving loom and comprising:

a fixed-blade group mounted on an end of an elongated fixed-blade carrying arm;

a movable-blade group mounted on an end of an elongated movable-blade carrying arm; and a motor operatively connected to the movable-blade group and arranged for providing a cutting movement of the movable-blade group in order to perform cutting of a weft yarn, the fixed-blade carrying arm and the movable-blade carrying arm adapted to extend respectively above and below a fabric holder of the loom in a direction of a reed of the loom so that a zone is formed in which the fixed-blade group and the movable-blade group overlap to enable cutting of the weft yarn.

9. The device of claim 8, wherein the cutting device is adapted to be slidably mounted on the at least one guide rail.

10. The device of claim 8, wherein the cutting device is adapted to be fixedly mounted on the at least one guide rail.

11. The device of claim 8, wherein the elongated fixed-blade carrying arm and the elongated movable-blade carrying arm are fixed to a single support in turn adapted to be mounted on the at least one guide rail.

12. The device of claim 8, wherein the motor is directly joined to the movable-blade carrying arm.

* * * * *